US007553600B2

(12) United States Patent
Kawamura et al.

(10) Patent No.: US 7,553,600 B2
(45) Date of Patent: Jun. 30, 2009

(54) METHOD FOR PRODUCING TONER AND POSITIVELY CHARGEABLE NON-MAGNETIC SINGLE COMPONENT TONER

(75) Inventors: Masateru Kawamura, Toyoake (JP); Jun Ikami, Ichinomiya (JP)

(73) Assignee: Brother Kogyo Kabushiki Kaisha (JP)

( * ) Notice: Subject to any disclaimer, the term of this patent is extended or adjusted under 35 U.S.C. 154(b) by 309 days.

(21) Appl. No.: 11/524,424

(22) Filed: Sep. 21, 2006

(65) Prior Publication Data

US 2007/0072103 A1 Mar. 29, 2007

(30) Foreign Application Priority Data

Sep. 29, 2005 (JP) ..... 2005-283574

(51) Int. Cl.
*G03G 9/08* (2006.01)

(52) U.S. Cl. ..... 430/137.14; 430/108.2; 430/109.4

(58) Field of Classification Search ..... 430/108.2, 430/137.14, 109.4, 108.1
See application file for complete search history.

(56) References Cited

U.S. PATENT DOCUMENTS

| | | | | |
|---|---|---|---|---|
| 4,840,863 | A | 6/1989 | Otsu et al. | |
| 5,385,802 | A | 1/1995 | Inaba et al. | |
| 6,248,491 | B1 * | 6/2001 | Takayanagi et al. .... | 430/123.53 |
| 2006/0257775 | A1 * | 11/2006 | Hawkins et al. ..... | 430/108.22 |

FOREIGN PATENT DOCUMENTS

| | | | |
|---|---|---|---|
| EP | 0 306 330 | A2 | 3/1989 |
| JP | 63060458 | A | 3/1988 |
| JP | 1062666 | A | 3/1989 |
| JP | 1077075 | A | 3/1989 |
| JP | 1257856 | A | 10/1989 |
| JP | 04194868 | A | 7/1992 |
| JP | 04241361 | A | 8/1992 |
| JP | 5-119513 | | 5/1993 |
| JP | 10-293419 | | 11/1998 |
| JP | 11-242356 | | 9/1999 |
| JP | 11327202 | A | 11/1999 |
| JP | 2000-338723 | | 12/2000 |
| JP | 2001-100454 | | 4/2001 |
| JP | 2003-098741 | | 4/2003 |

OTHER PUBLICATIONS

Japanese Office Action dated Jan. 8, 2008 of Appl. No. 2005-283574.

* cited by examiner

*Primary Examiner*—John L Goodrow
(74) *Attorney, Agent, or Firm*—Banner & Witcoff, Ltd.

(57) ABSTRACT

Methods are described for rendering toner particles that are capable of being sufficiently and uniformly charged. The particles may be positively chargeable, non-magnetic, single component toner particles. At least one production method includes emulsifying a charge-controlling agent formed of a synthetic resin in an aqueous medium, the charge-controlling agent having been dissolved in or swollen with an organic solvent; removing the organic solvent; mixing with a suspension of toner base particles containing a binder and a colorant; and heating to fix the charge-controlling agent on the surfaces of the toner base particles. According to at least one method, a positively chargeable non-magnetic single component toner can be produced such that the amount of the charge-controlling agent deposited on the surfaces of the toner base particles falls within a range of 0.2 to 3.0 wt. %, with respect to the total weight of the toner.

9 Claims, No Drawings

METHOD FOR PRODUCING TONER AND POSITIVELY CHARGEABLE NON-MAGNETIC SINGLE COMPONENT TONER

CROSS-REFERENCE TO RELATED APPLICATIONS

This Nonprovisional application claims priority under 35 U.S.C. § 119(*a*) on Patent Application No. 2005-283574 filed in Japan on Sep. 29, 2005, the entire contents of which are hereby incorporated by reference.

BACKGROUND OF THE INVENTION

1. Field of the Invention

The present invention relates to a method for producing a powder-form toner for forming a visible image in electrophotography, electrostatic recording, and other imaging techniques, and to a positively chargeable non-magnetic single component toner containing no magnetic carrier particles, which can be employed for forming the visible image through being positively charged. Unless otherwise specified, the term "charged" refers to "electrically charged."

2. Background Art

In an image formation apparatus employing an imaging method such as electrophotography or electrostatic imaging, a toner which has been charged in a predetermined amount and with a predetermined polarity is supplied to an image forming portion, and the toner particles are arranged image-wise on a recording sheet through application of an electric field. Through fixing the thus-arranged toner particles on the recording sheet, an image of interest is formed on the sheet.

The aforementioned toner employed in the image formation apparatus is generally formed of at least a binder resin (hereinafter referred to simply as a binder), a colorant, and a charge-controlling agent. The binder, which is a predominant component of the toner, is made of a thermoplastic synthetic resin. The binder is melted in the course of fixation of the toner, whereby the toner image is fixed on a recording sheet. The colorant, which is a substance for imparting a predetermined color to the toner, is generally a pigment or a dye. The charge-controlling agent is a substance for controlling chargeability of the toner.

Currently, two formats are widely known to supply a charged toner to an image forming portion; i.e., a magnetic two-component format and a non-magnetic single component format. The magnetic two-component format employs triboelectricity generated from magnetic carrier particles and a toner. The non-magnetic single component format employs no magnetic carrier particles, but triboelectricity generated from a toner and other members (e.g., a metal or synthetic resin plate-like blade and/or a roller made of synthetic resin). In recent years, the non-magnetic single component format has been more widely employed, since the format is advantageously employable in a small-scale image formation apparatus.

In order to consistently provide an excellent visible image of a toner, toner particles must be consistently charged. In other words, the toner particles must be charged as uniformly as possible, while the particles maintain a sufficient amount of electricity. In the magnetic two-component format, the magnetic carrier particles and the toner are almost uniformly mixed at a predetermined ratio, and therefore the toner particles are readily charged sufficiently and uniformly. From the viewpoint of production of sufficiently and uniformly charged toner particles, the magnetic two-component format employing the magnetic carrier is more advantageous than the non-magnetic single component format.

Therefore, when the non-magnetic single component format is employed, controlling the charging characteristics of toner particles by use of a charge-controlling agent is an important factor for providing sufficiently and uniformly charged toner particles.

Japanese Patent Application Laid-Open (kokai) No. 5-119513 discloses a toner formed of toner particles containing therein a charge-controlling resin (i.e., a synthetic resin serving as the charge-controlling agent) and containing the charge-controlling agent on the surfaces of the particles.

Japanese Patent Application Laid-Open (kokai) No. 10-293419 discloses a toner formed of generally spherical toner particles which surfaces are coated firmly with a thermoplastic resin region where a charge-controlling agent is uniformly dispersed. The toner is produced through the following procedure. Firstly, a synthetic resin which becomes self-dispersible or soluble in water through neutralization is neutralized with a neutralizing agent, to thereby prepare a self-water-dispersible or water soluble resin. Secondly, the self-water-dispersible or water soluble resin is mixed with a charge-controlling agent and an organic solvent, and the mixture is emulsified through phase inversion, to thereby form an aqueous dispersion having a particle size smaller than that of the generally spherical particles. Thirdly, the aqueous dispersion is mixed with a dispersion of the generally spherical particles. To the resultant mixture, another neutralizing agent having a polarity opposite that of the aforementioned neutralizing agent is added, followed by drying. In other words, the synthetic resin containing the aforementioned charge-controlling agent is fixed on the surfaces of the generally spherical particles by use of the second neutralizing agent.

The aforementioned toners have already been commercialized both in the positively chargeable type and the negatively chargeable type. Particularly in the aforementioned electrophotographic image formation apparatus, a positively chargeable toner is suitably employed so as to prevent generation of ozone.

The binder serving as a predominant component of the toner is generally formed of a polyester resin or a styrene-acrylic copolymer. However, these resins per se are prone to be negatively charged.

Thus, when a conventional polyester resin or styrene-acrylic copolymer is employed as a binder of a positively chargeable non-magnetic single component toner, the toner particles are difficult to charge sufficiently and uniformly.

SUMMARY OF THE INVENTION

The present invention has been conceived to solve the aforementioned problems, and an object of the present invention is to achieve more sufficient and uniform charging of toner particles (in particular, positively chargeable non-magnetic single component toner particles).

Accordingly, the present invention provides a method for producing a toner comprising the following steps:

emulsifying a charge-controlling agent formed of a synthetic resin having a polar group in an aqueous medium, the charge-controlling agent having been dissolved in or swollen with an organic solvent, to thereby form an emulsion;

removing the organic solvent from the emulsion, to thereby form a suspension of the charge-controlling agent;

mixing the suspension of the charge-controlling agent with a suspension of toner base particles (i.e., resinous particles containing binder resin and colorant) containing a binder and a colorant, to thereby form a mixture; and heating the mixture containing the suspension of the charge-controlling agent and the suspension of the toner base particles, to thereby fix the charge-controlling agent on the surfaces of the toner base particles.

In the step of forming the emulsion carried out in the above production method, the charge-controlling agent having a polar group and having been dissolved in or swollen with an organic solvent is readily and consistently emulsified in an aqueous medium. Thus, a suspension of the charge-controlling agent microparticles with less aggregation can be obtained in the step of producing the suspension. Through mixing the suspension and the suspension of the toner base particles, the surfaces of the toner base particles are uniformly coated with the charge-controlling agent microparticles formed of a synthetic resin. When the thus-coated toner base particles are heated, the charge-controlling agent is uniformly fixed on the surfaces of the toner base particles. Thus, the toner produced through this method can be charged sufficiently and uniformly.

The organic solvent employed in the invention can dissolve or swell the charge-controlling resin, and preferably has a certain degree of water solubility so that the counter ion of the charge-controlling resin can be released during mixing with an aqueous phase. Examples of preferably employed organic solvents include ethyl acetate, methyl ethyl ketone (MEK), tetrahydrofuran (THF), and acetone.

The polar group employed in the invention is preferably an amino group, a quaternary ammonium group, etc.

The aforementioned emulsion forming step may further include a step of mixing the charge-controlling agent with the organic solvent and a step of emulsifying the thus-produced mixture in an aqueous medium. In this case, the production method according to the present invention comprises the following steps:

mixing a charge-controlling agent formed of a synthetic resin having a polar group with an organic solvent, to thereby form a first mixture;

emulsifying the first mixture in an aqueous medium, to thereby form an emulsion;

removing the organic solvent from the first mixture contained in the emulsion, to thereby form a suspension of the charge-controlling agent;

mixing the suspension of the charge-controlling agent with a suspension of toner base particles containing a binder and a colorant, to thereby form a second mixture; and heating the second mixture, to thereby fix the charge-controlling agent on the surfaces of the toner base particles.

Through the above method, the toner can be produced in a simple manner at low cost.

The aforementioned polar group preferably has a salt structure. By virtue of the presence of the salt structure, an emulsion in an excellent emulsifying state can be produced without using a neutralizing agent or a surfactant in the production step. Therefore, an agent which may possibly impede sufficient and uniform charging of the toner particles such as a neutralizing agent is not deposited on the surfaces of the toner particles. Thus, the toner produced through the above method can be charged more sufficiently and uniformly.

The salt structure employed in the invention is preferably a quaternary ammonium salt structure, a phosphonium salt structure, etc. Of these, a quaternary ammonium salt structure is more preferred. Through employment of such a salt structure, a toner which can be sufficiently and uniformly charged can be produced in a simple manner at low cost.

In the step of mixing the suspension of the charge-controlling agent with the suspension of the toner base particles containing a binder and a colorant, the two suspensions are preferably mixed such that the charge-controlling agent content of the toner is adjusted to 0.2 to 3.0 wt. %. Through employment of the mixing step, excellent characteristics of the produced toner can be maintained, and charging characteristics of the toner can be consistently enhanced.

In other words, when the charge-controlling agent content is not lower than the lower limit of the above range, a sufficient amount of the charge-controlling agent is uniformly fixed on the surfaces of the toner base particles. Therefore, charging characteristics of the toner particles can be well controlled by the charge-controlling agent. When the charge-controlling agent content is not higher than the upper limit of the above range, the produced toner can be charged sufficiently and uniformly without deteriorating the toner characteristics provided by the binder (e.g., fixation characteristics).

The binder is preferably a polyester resin. Although a polyester-based toner can be fixed at low temperature, charging characteristics of such a polyester-based toner are varied by moisture. However, according to the present invention, such a polyester-based toner can be produced so that the toner particles can be charged more sufficiently and uniformly.

The toner is preferably positively chargeable. Even when a conventional binder such as polyester resin or styrene-acrylic copolymer is employed, a positively chargeable toner produced according to the invention can be charged more sufficiently and uniformly.

The toner is preferably a non-magnetic single component toner. A positively chargeable non-magnetic single component toner produced according to the invention can be charged more sufficiently and uniformly.

The toner base particles may have a charging polarity opposite that of the charge-controlling agent, the polarity being evaluated with reference to the tribocharging tendency. In this case, the charge-controlling agent microparticles can be firmly and uniformly fixed on all toner base particles electrostatically. Thus, formation of toner particles having a polarity opposite that which would otherwise be formed can be effectively prevented.

The step of fixing the charge-controlling agent on the surfaces of the toner base particles is preferably performed under the conditions of 55 to 70° C., 15 to 120 minutes, and pH of 6 to 10.5, more preferably 55 to 70° C., 30 to 120 minutes, and pH of 6 to 10.5. Through the fixing step, the toner base particles are more consistently coated with the synthetic resin, which is an ingredient of the charge-controlling agent. Thus, the produced toner can be charged more sufficiently and uniformly.

(2) The positively chargeable non-magnetic single component toner of the present invention comprises toner base particles containing a binder and a colorant, and a positively chargeable charge-controlling agent deposited on the surfaces of the toner base particles.

A characteristic feature of the invention resides in that the charge-controlling agent is formed of a synthetic resin having a polar group, and that the charge-controlling agent (deposited on the toner base particles) content of the toner falls within a range of 0.2 to 3.0 wt. %.

In the positively chargeable non-magnetic single component toner (hereinafter referred to simply as toner) containing the aforementioned ingredients, the charge-controlling agent is formed of a synthetic resin. Therefore, a sufficient amount of the charge-controlling agent is uniformly fixed on the surfaces of the toner base particles. Therefore, charging characteristics of the toner particles can be well controlled by the charge-controlling agent.

As described above, the charge-controlling agent has a polar group. The charge-controlling agent can be satisfactorily emulsified in an aqueous medium, when it has been dissolved in or swollen with an organic solvent. Thus, by removing (vaporizing) the organic solvent, a suspension of the charge-controlling agent microparticles with less aggregation can be obtained. Through mixing the suspension and the suspension of the toner base particles, the surfaces of the toner base particles are uniformly coated with the charge-controlling agent microparticles formed of a synthetic resin. Thus, according to the present invention, a toner which can be charged sufficiently and uniformly can be produced in a simple production process at low cost.

The aforementioned polar group preferably has a salt structure. By virtue of the presence of the salt structure, the charge-controlling agent is uniformly deposited on the surfaces of the toner base particles without using a neutralizing agent or a surfactant in the production step. Therefore, an agent which may possibly impede sufficient and uniform charging of the toner particles such as a neutralizing agent is not deposited on the surfaces of the toner particles. Thus, the toner produced through the above method can be charged more sufficiently and uniformly.

The salt structure employed in the invention is preferably a quaternary ammonium salt structure, a phosphonium salt structure, etc. Of these, a quaternary ammonium salt structure is more preferred. Through employment of such a salt structure, a positively chargeable non-magnetic single component toner which can be charged more sufficiently and uniformly can be produced.

The toner base particles may have a negative polarity as evaluated with reference to the tribocharging tendency. Even when the toner base particles (binder particles) have a polarity opposite the desired polarity (i.e., positive) of the toner, the positively charged toner can be consistently produced. In other words, formation of toner particles having a polarity opposite that which would otherwise be formed can be effectively prevented.

The binder is preferably a polyester resin. Although a polyester-based toner can be fixed at low temperature, charging characteristics of such a polyester-based toner are varied by moisture. However, according to the present invention, such a polyester-based toner can be produced so that the toner particles can be positively charged more sufficiently and uniformly.

DETAILED DESCRIPTION OF PREFERRED EMBODIMENTS

Embodiments of the present invention will next be described.

General Composition of Positively Chargeable Non-Magnetic Single Component Toner In one embodiment of the present invention, the positively chargeable non-magnetic single component toner (hereinafter referred to simply as toner) is formed of toner base particles, a charge-controlling resin, and an external additive. The toner base particles is formed of a binder, a colorant, and a releasing agent.

The binder is a synthetic resin forming a predominant component of a toner (toner base particles), and fixed on a recording medium (e.g., paper sheet or OHP sheet) through heating and/or pressure application. The colorant is a substance for imparting a predetermined color to the toner, and is incorporated into the binder through dispersion or permeation. The releasing agent is mixed with the binder or deposited on the binder particles.

The charge-controlling resin is a synthetic resin which is added to the toner in order to consistently impart predetermined charging characteristics (polarity and amount of charge) to the toner particles. The charge-controlling resin is in the form of microparticles considerably smaller than the toner base particles. The charge-controlling resin microparticles are deposited on the surfaces of the toner base particles.

The external additive is a substance for regulating charging characteristics, flowability, storage stability, etc., of the toner, and is in the form of ultra-microparticles considerably smaller than the toner base particles. The external additive is deposited on or buried in the surfaces of the toner base particles and charge-controlling resin particles.

Binder Resin

No particular limitation is imposed on the type of the binder, and any binders conventionally employed as toner binders may be employed. Examples of the binder include homopolymers of styrene or its derivative such as polystyrene, poly(p-chlorostyrene), and polyvinyltoluene; styrene-styrene derivative copolymers such as styrene-p-chlorostyrene copolymer and styrene-vinyltoluene copolymer; styrene copolymes such as styrene-vinyinaphthalene copolymer, styrene-acrylic acid-based copolymer, styrene-methacrylic acid-based copolymer, styrene-methyl $\alpha$-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; other resins such as polyvinyl chloride, phenolic resin, naturally modified phenolic resin, natural resin-modified maleic acid resin, acrylic resin, methacrylic resin, polyvinyl acetate, silicone resin, polyester resin, polyurethane, polyamide resin, furan resin, epoxy resin, polyvinyl butyral, terpene resin, coumarone-indene resin, and petroleum resin. These resins may be used singly or in combination of two or more species.

Particularly when a full-color toner is provided, the binder is required to be transparent, to assume substantially colorless in such a degree that color tone of the toner image is not affected, to have excellent compatibility to the charge-controlling resin, to have appropriate flowability under thermal or pressure conditions, and to be formed into microparticles. Among the above binders, styrene resin, acrylic resin, styrene-acrylic copolymer, and polyester resin are preferred. Polyester resin is most preferred from the viewpoint of sufficient and uniform charging and image quality.

Colorant

Widely known dyes and pigments may be used singly or in combination.

Examples of the colorant for producing a full-color toner include organic pigments such as Quinophthalone Yellow, Hansa Yellow, Isoindolinone Yellow, Benzidine Yellow, Perynone orange, Perynone Red, Perylene Maroon, Rhodamine 6G Lake, Quinacridone Red, Rose Bengal, Copper Phthalocyanine Blue, Copper Phthalocyanine Green, and a diketopyrrolopyrole pigment; inorganic pigments and metal powders such as carbon black, Titanium White, Titanium Yellow, ultramarine, Cobalt Blue, red iron oxide, aluminum powder, and bronze; oil-thinnable dyes and dispersion dyes such as azo dyes, quinophthalone dyes, anthraquinone dyes, xanthene dyes, triphenylmethane dyes, phthalocyanine dyes, indophenol dyes, and indoaniline dyes; triarylmethane dyes modified with resin such as rosin, rosin-modified phenol, or rosin-modified maleic acid; and other dyes and pigments treated with higher fatty acid or resin.

In the case where a mono-chromatic color toner, the colorant may be prepared through appropriately mixing a pigment and a dye of the same color; e.g., rhodamine pigment and dye, quinophthalone pigment and dye, or phthalocyanine pigment and dye.

Releasing Agent

Any releasing agents which have conventionally been employed or which may be employed as releasing agents for toner may be used. Examples of the releasing agent which may be used in the invention include polyolefin wax such as low-molecular weight polyethylene, low-molecular weight polypropylene, and low-molecular weight polybutylene; plant-derived natural waxes such as candelilla wax, carnauba wax, rice wax, Japan wax, and Jojoba wax; petroleum waxes and modified waxes thereof such as paraffin, microcrystalline, and petrolatum; synthetic waxes such as Fischer-Tropsch wax; polyfunction ester compounds such as pentaerythritol tetramyristate, pentaerythritol tetrapalmitate, and dipentaerythritol hexapalmitate. These releasing agents may be used singly or in combination of two or more species.

Charge-Controlling Resin

The charge-controlling resin preferably has a molecular weight (Mw: weight average) of 3,000 to 100,000. When the molecular weight is less than 3,000, the resin has poor strength, and toner particles are readily aggregated, whereas when the molecular weight is in excess of 100,000, the resin becomes excessively hard, impairing fixation performance. Needless to say, the charge-controlling resin may be cross-linked.

The charge-controlling resin in the form of microparticles preferably has a glass transition temperature (Tg) almost equivalent to or slightly higher than the Tg of the resin forming the toner base particles. For example, when the toner resin has a Tg of 60° C., the microparticle-form charge-controlling resin preferably has a Tg of 60 to 65° C.

The microparticle-form charge-controlling resin preferably has a particle size as small as possible, since the microparticles are more uniformly deposited on the surfaces of the toner base particles. For example, when the toner base particles have a particle size of 8 μm, the charge-controlling resin preferably has a particle size of 2 μm or less.

The charge-controlling resin preferably has a polar group. Examples of the polar group employed in the invention for imparting positive charge to a toner include a quaternary ammonium group, a group having a quaternary ammonium salt structure, an amino group, and a group having a phosphonium salt structure. Particularly, a group having a salt structure is preferably employed. Most preferably, the charge-controlling resin has a polar group having a quaternary ammonium (salt) structure.

The charge-controlling resin having a quaternary ammonium (salt) structure is available as commercial product. Alternatively, copolymers having a quaternary ammonium (salt) group produced through methods disclosed in Japanese Patent Application Laid-Open (kokai) Nos. 63-60458, 3-175456, 3-243954, 11-15192, etc. may also be employed. Examples of the above commercial product include FCA-207P (synthetic resin (styrene: 83%, butyl acrylate: 15%, and N,N-diethyl-N-methyl-2-(methacryloyloxy)ethylammonium p-toluenesulfonate: 2%) having a weight average molecular weight (Mw) of 12,000 and a glass transition temperature (Tg) of 67° C., product of Fujikura Kasei Co., Ltd.) and FCA-201 PS (product of the same company).

The polar group content of the charge-controlling resin may be appropriately regulated through modification of copolymerization conditions. For example, when the charge-controlling resin is a styrene-acrylic copolymer, the polar group content can be regulated by modifying the amount of acrylic co-monomer.

To the toner base particles, a basic dye such as a Nigrosine dye or a triarylmethane dye, which exhibits high charging performance as a positively chargeable charge-controlling agent, may be added. Briefly, these charge-controlling dyes and the aforementioned charge-controlling resin may be used in combination.

External Additives

The external additive may be inorganic particles or synthetic resin particles. Examples of the inorganic compound forming the particles include silica, aluminum oxide, titanium oxide, silicon aluminum oxide, silicon titanium oxide, and a hydrophobicized product thereof. Upon hydrophobicizing treatment of silica micropowder, silicone oil or a silane coupling agent such as dichlorodimethylsilane, hexamethyldisilazane, or tetramethyldisilazane may be used. Examples of the synthetic resin particles include methacrylate ester polymer particles, acrylate ester polymer particles, styrene-methacrylate ester copolymer particles, styrene-acrylate ester copolymer particles, and core-shell particles (core: styrene polymer, shell: methacrylate ester copolymer).

No particular limitation is imposed on the amount of the external additive(s). The amount is generally 0.1 to 6 parts by weight with respect to 100 parts by weight of a base toner (i.e., raw toner before addition of external additives) formed of the toner base particles and the charge-controlling resin.

Method for Producing the Toner

The outline of the method of the present invention for producing a toner will next be described, focusing on the production of the aforementioned base toner.

Production of Toner Base Particles

The aforementioned toner base particles may be produced through any of a variety of conventionally known methods. For example, pulverization, suspension polymerization, emulsion polymerization, emulsion polymerization-aggregation, or a dissolution/suspension method (emulsion dispersion or drying in liquid) may be applied. Alternatively, toner base particles formed of spherical polyester particles are suitably produced through a method in which resin particles are neutralized so as to be self-dispersed in water, to thereby form microparticles, and the particle size is modified to a size of interest through condensation.

Through employment of the above methods, the toner base particles having a desired particle size are produced.

Deposition of the Charge-Controlling Resin on the Surfaces of the Toner Base Particles The thus-produced toner base particles are mixed with the charge-controlling resin microparticles, whereby the charge-controlling resin microparticles are electrostatically deposited on the surfaces of the toner base particles. The mixing may be performed in gas phase or liquid phase. In other words, the charge-controlling resin microparticles and the toner base particles may be mixed with each other under dry conditions (in a powder state). Alternatively, a suspension of the charge-controlling resin microparticles may be mixed with the toner base particles. In order to deposit the charge-controlling resin microparticles more uniformly on the surfaces of the toner base particles, mixing in a liquid phase is preferred.

Preparation of Suspension of the Charge-Controlling Resin Microparticles

The suspension of the charge-controlling resin microparticles subjected to the aforementioned liquid-phase mixing may be prepared through the following steps.

The charge-controlling resin having a polar group (in particular, a salt structure) is dissolved in or swollen with an organic solvent. The thus-treated resin forms an emulsion in a fine emulsification state in an aqueous medium. The emulsion formation step may include a step of mixing the charge-controlling resin with an organic solvent and a step of emulsifying the thus-obtained mixture in an aqueous medium. Alternatively, the emulsion formation step may include a step of mixing water and an organic solvent and a step of adding the charge-controlling resin to the mixture, followed by stirring.

According to the emulsifying method, an emulsion of a fine emulsification state can be formed without adding additives such as a surfactant or a neutralizing agent. Notably, emulsification conditions and emulsion droplet size vary depending on the type and amount of the polar group contained in the charge-controlling resin.

The organic solvent employed in the invention can dissolve or swell the charge-controlling resin, and preferably has a certain degree of water solubility so that the counter ion of the charge controlling resin can be released during mixing with an aqueous phase. Examples of preferably employed organic solvents include ethyl acetate, methyl ethyl ketone (MEK), tetrahydrofuran (THF), and acetone.

Through removal of the liquid components from the emulsion through a known technique such as heating or pressure reduction, a suspension in which the charge-controlling resin microparticles are well dispersed in the aqueous medium can be prepared.

Fixation of the Charge-Controlling Resin on the Surfaces of the Toner Base Particles By heating the thus-obtained mixture under stirring, the charge-controlling resin microparticles are uniformly fixed on the surfaces of the toner base particles. The total amount of the fixed microparticles may be controlled through modifying the conditions under which the mixing with the toner base particles is performed. For example, amount of the charge-controlling resin microparticles, treatment temperature, treatment time, stirring conditions, or pH (in the case of liquid phase) is modified. Under specifically regulated conditions, a base toner in the form of microcapsules in which the toner base particles are coated with the charge-controlling resin can be formed by softening the resin particles deposited on the surfaces of the toner base particles. Alternatively, when the toner particle resin has a Tg lower than that of the charge-controlling resin, the toner base particles are softened during fixation treatment, whereby a base toner in which the charge-controlling resin microparticles are buried in the surface portions of the toner base particles can be formed.

Addition of External Additive(s)

Finally, the aforementioned external additives are incorporated into the thus-obtained base toner. No particular limitation is imposed on the method of addition. For example, the base toner and the external additive(s) may be mixed with stirring by means of a high-speed agitator such as a Henschel mixer.

EXAMPLES

The present invention will next be described in detail by way of example, which should not be construed as limiting the invention thereto. In the following description relating to the toner and the production method, the unit "part(s)" (component proportions) refers to "part(s) by weight."

Production of Charge-Controlling Resin Microparticles 1

A positively chargeable charge-controlling resin (product of Fujikura Kasei Co., Ltd., Tg: about 66° C.) including a polar group having a quaternary ammonium salt structure (20 parts), methyl ethyl ketone (80 parts), and distilled water (100 parts) were mixed, and the mixture was agitated by means of a homogenizer at 8,000 rpm for 30 minutes, to thereby prepare an emulsion. The emulsion was agitated by means of a meniscoid-form impeller at 120 rpm in a water bath at 60° C. so as to vaporize the solvent, whereby an aqueous dispersion of charge-controlling resin microparticles having a volume mean particle size (Dv) of 0.44 μm (CCR1) was formed. The thus-produced dispersion was found to have a solid content of 22.4 wt. %.

Production of Charge-Controlling Resin Microparticles 2

The above positively chargeable charge-controlling resin (30 parts), methyl ethyl ketone (70 parts), and distilled water (100 parts) were mixed, and the mixture was agitated by means of a homogenizer at 8,000 rpm for 30 minutes, to thereby prepare an emulsion. The emulsion was agitated by means of a meniscoid-form impeller at 120 rpm in a water bath at 60° C. so as to vaporize the solvent, whereby an aqueous dispersion of charge-controlling resin microparticles having a volume mean particle size (Dv) of 0.78 μm (CCR2) was formed.

Production of Charge-Controlling Resin Microparticles 3

The above positively chargeable charge-controlling resin (40 parts), methyl ethyl ketone (60 parts), and distilled water (100 parts) were mixed, and the mixture was agitated by means of a homogenizer at 20,000 rpm for 30 minutes, to thereby prepare an emulsion. The emulsion was agitated by means of a meniscoid-form impeller at 120 rpm in a water bath at 60° C. so as to vaporize the solvent, whereby an aqueous dispersion of charge-controlling resin microparticles having a volume mean particle size (Dv) of 1.50 μm (CCR3) was formed.

Production of Charge-Controlling Resin Microparticles 4

The above positively chargeable charge-controlling resin (20 parts), methyl ethyl ketone (60 parts), and distilled water (100 parts) were mixed, and the mixture was agitated by means of a homogenizer at 20,000 rpm for 30 minutes, to thereby prepare an emulsion. The emulsion was agitated by means of a meniscoid-form impeller at 120 rpm in a water bath at 60° C. so as to vaporize the solvent, whereby an aqueous dispersion of charge-controlling resin microparticles having a volume mean particle size (Dv) of 0.21 μm (CCR4) was formed.

Deposition and Fixation of Charge-Controlling Resin Microparticles on the Surfaces of Toner Base Particles Polyester spherical particles which had been produced through the aggregation method were employed as toner base particles (Tg: about 62° C.). A suspension of the toner base particles (100 parts) and each of the above-produced positively chargeable charge-controlling resin microparticle aqueous dispersions were mixed under predetermined conditions (amount of the aqueous dispersion of charge-controlling resin microparticles, treatment temperature, treatment time, and pH), whereby charge-controlling resin microparticles were deposited on the surfaces of the toner base particles. Subsequently, the solid content of the mixture was separated through a known filtration method, sufficiently washed with water, and dried, to thereby form a powder-form base toner. Hydrophobic silica (1 part) was added to the dried base toner (100 parts), to thereby produce a toner.

Toners 1 to 11 were produced from charge-controlling resin microparticles under mixing conditions shown in Table 1. In Table 1, "Dv" denotes a volume mean particle size of the toner base particles. Dv was determined by means of a Coulter multisizer II (aperture: 100 μm, product of Beckman Coulter).

Toner 12 was produced as a toner of Comparative Example. Toner 12 was produced through incorporation of the positively chargeable charge-controlling resin into toner base particles. Specifically, a base toner of Toner was produced by mixing a polyester resin with the positively chargeable charge-controlling resin at a weight ratio of 20:0.6. The same type and amount of external additive was added to the thus-produced base toner, to thereby produce toner 12.

TABLE 1

| Toner | CCR Type | Dv (μm) | Amount of CCR (parts) | Treatment temp. (° C.) | Time (min) | pH at treatment | CCR deposition (wt. %) | Charge (μC/g) | Fog on sheet (ΔY) | Fog on sheet visible |
|---|---|---|---|---|---|---|---|---|---|---|
| 1 | CCR1 | 9.30 | 3 | 55 | 60 | 6 | 3.00 | 48.8 | 0.1 | AA |
| 2 | CCR1 | 8.50 | 1.5 | 65 | 15 | 9 | 1.49 | 48 | 0.1 | AA |
| 3 | CCR1 | 8.83 | 2 | 55 | 30 | 9 | 1.94 | 26.3 | 0.6 | BB |
| 4 | CCR1 | 8.48 | 0.5 | 55 | 120 | 10.5 | 0.37 | 33.3 | 0.2 | AA |
| 5 | CCR1 | 8.46 | 0.5 | 65 | 15 | 6 | 0.20 | 28.9 | 0.5 | BB |
| 6 | CCR1 | 8.66 | 3 | 65 | 30 | 9 | 1.69 | 40.3 | 0.1 | AA |
| 7 | CCR1 | 8.45 | 0.5 | 45 | 15 | 6 | 0.16 | −13.1 | 5 | CC |
| 8 | CCR1 | 9.60 | 5 | 65 | 30 | 10.5 | 3.40 | 8.8 | 2.3 | CC |
| 9 | CCR2 | 8.62 | 0.5 | 65 | 30 | 9 | 0.50 | 38.8 | 0.1 | AA |
| 10 | CCR3 | 8.70 | 0.5 | 65 | 30 | 9 | 0.60 | 30 | 0.2 | AA |
| 11 | CCR4 | 8.51 | 1 | 60 | 60 | 9 | 0.80 | 45.5 | 0.1 | AA |
| 12 | — | 9.20 | — | — | — | — | — | −28.8 | 4.6 | CC |

In Table 1, "CCR deposition amount" denotes the amount of charge-controlling resin actually deposited on the toner base particles, and is calculated as follows.

The supernatant of each suspension after resin particle deposition was collected and dehydrated through evaporation. In this case, the amount (g) of charge-controlling resin remaining in the supernatant (A) was calculated. The amount (g) of charge-controlling resin actually added for deposition (B) is already known. Accordingly, the amount of charge-controlling resin actually deposited on the toner base particles is represented by B-A (g). The amount was reduced to a relative amount (wt. %) with respect to the weight of toner, whereby "CCR deposition amount" in Table 1 was calculated.

Each of the above-produced toners 1 to 12 was charged into a non-magnetic single component developing apparatus of a laser printer. A printing test was performed through measuring the amount of charge on a development roller and fog (background color concentration) on a printing sheet. The fog on a printing sheet was evaluated by difference between whiteness of a non-printed sheet (Y0) and whiteness of a non-printed area of the printed sheet (Y1); i.e., $\Delta Y = Y0 - Y1$. The whiteness values Y0 and Y1 were determined by means of a whiteness checker (product of Nippon Denshoku Industries Co., Ltd.). The results are also shown in Table 1.

As shown in Table 1, in the production of toners 1 to 11, the charge-controlling resin were deposited on the toner base particles under the conditions: 55 to 70° C., 15 to 120 minutes, and pH of 6 to 10.5.

Toners 5 and 7 were produced under the same conditions (amount of charge-controlling resin, treatment time, pH for treatment) except for treatment temperature. As is clear from Table 1, as treatment temperature is elevated, the amount of charge-controlling resin actually deposited on the surfaces of the toner base particles increases slightly. Thus, higher treatment temperature realizes production of toner particles having sufficient and uniform positive charge.

Toners 6 and 8 were produced under the same conditions (treatment temperature and time conditions) except for amount of charge-controlling resin added. Among toners 1 to 11, toner 8, which was produced with charge-controlling resin in the largest amount, exhibited an amount of charge-controlling resin actually deposited on the surfaces of the toner base particles in excess of 3.0 wt. %.

Toners 1 to 6 and 9 to 11, which were produced under the conditions of 55 to 70° C., 30 to 120 minutes, and pH of 6 to 10.5, were positively charged. Toners 1 to 6 and 9 to 11, which had an amount of actually deposited charge-controlling resin of 0.2 to 3.0 wt. %, exhibited sufficient positive charge for serving as a positively chargeable non-magnetic single component toner. In the printing test, toners 1 to 6, 9, and 11 provided excellent images having less fog in printing sheets.

When other charge-controlling resins and toner base particles (including toner base particles obtained by pulverization) falling within the scope of the present invention were employed, similarly excellent results were obtained.

In contrast, toner 12 (Comparative Example) was negatively charged, and provided poor printing images with much fog.

As described hereinabove, the method for producing a toner carried out in the Examples includes the following steps: emulsifying a charge-controlling agent formed of a synthetic resin having a quaternary ammonium salt structure-containing polar group in an aqueous medium, the charge-controlling agent having been dissolved in or swollen with an organic solvent, to thereby form an emulsion; removing the organic solvent from the emulsion, to thereby form a suspension of the charge-controlling agent; mixing the suspension of the charge-controlling agent with a suspension of toner base particles containing a binder and a colorant, to thereby form a mixture; and heating the mixture containing the suspension of the charge-controlling agent and the suspension of the toner base particles, to thereby fix the charge-controlling agent on the surfaces of the toner base particles. Thus, an appropriate amount of positively chargeable charge-controlling resin can be uniformly and consistently deposited on the surfaces of toner base particles. The thus-produced toner was positively and sufficiently charged.

In contrast, when a positively chargeable charge-controlling resin is mechanically pulverized in a conventional manner, the particle size is varied. Even when such charge-controlling resin particles are subjected to mechanical coating treatment such as hybridization, a uniformly and positively chargeable toner cannot be produced. In addition, when toner base particles are chemically coated with such pulverized CCR microparticles in liquid phase, uniformly charged toner particles are difficult to obtain due to variation in size of the pulverized CCR microparticles.

Conventionally, there has been employed a method for producing a toner including producing resin microparticles containing a large amount of charge-controlling agent (e.g., Nigrosine) through a chemical technique and depositing the resin microparticles on the surfaces of toner base particles. According to this method, the charge-controlling agent is virtually completely buried in the resin microparticles. In such a case, particularly in the case of a non-magnetic single component format, positively chargeable toner particles which can be charged sufficiently and uniformly are difficult to produce, although the present invention attains production of such positively chargeable toner particles.

The above-described embodiment and examples are merely typical embodiment and examples of the present invention which were considered best by the present inventors at the time when the present application was filed. Therefore, it should be understood that the present invention is not limited to the above-described embodiment and Examples, and various modifications of the invention may be made so long as the essentials of the present invention are not changed.

Operationally or functionally described elements constituting means for achieving the objects of the present invention encompass, in addition to specific structures disclosed in the aforementioned embodiment and examples, any structure capable of attaining the same operation or function.

What is claimed is:

1. A method for producing a toner containing a binder, a colorant, and a charge-controlling agent, the method comprising: emulsifying a charge-controlling agent formed of a synthetic resin having a polar group in an aqueous medium, the charge-controlling agent having been dissolved in or swollen with an organic solvent, to thereby form an emulsion; removing the organic solvent from the emulsion, to thereby form a suspension of the charge-controlling agent; mixing the suspension of the charge-controlling agent with a suspension of toner base particles containing the binder and the colorant, to thereby form a mixture; and heating the mixture containing the suspension of the charge-controlling agent and the suspension of the toner base particles, to thereby fix the charge-controlling agent on the surfaces of the toner base particles.

2. A method for producing a toner as described in claim 1, wherein the polar group has a salt structure.

3. A method for producing a toner as described in claim 2, wherein the salt structure includes a quaternary ammonium salt structure.

4. A method for producing a toner as described in claim 3, wherein the suspension of toner base particles containing the binder and the colorant and the suspension of the charge-controlling agent are mixed with each other such that the toner has a charge-controlling agent content of 0.2 to 3.0 wt. %.

5. A method for producing a toner as described in claim 4, wherein the binder is a polyester resin.

6. A method for producing a toner as described in claim 5, wherein the toner is positively chargeable.

7. A method for producing a toner as described in claim 6, wherein the toner is a non-magnetic single component toner.

8. A method for producing a toner as described in claim 7, wherein the toner base particles have a charging polarity opposite that of the charge-controlling agent, the polarity being evaluated with reference to the tribocharging tendency.

9. A method for producing a toner as described in claim 8, wherein fixing the charge-controlling agent on the surfaces of the toner base particles is performed under the conditions of 55 to 70° C., 15 to 120 minutes, and pH of 6 to 10.5.

* * * * *